United States Patent [19]

Costill

[11] Patent Number: 4,750,226

[45] Date of Patent: Jun. 14, 1988

[54] CARPET LAYING TOOL AND PROCESS FOR USING SAME

[76] Inventor: Robert G. Costill, 1835 Nancy Lee Dr., Akron, Ohio 44312

[21] Appl. No.: 920,756

[22] Filed: Oct. 20, 1986

[51] Int. Cl.[4] ..... B25F 1/00

[52] U.S. Cl. ..... 7/103; 254/200; 81/488; D8/15

[58] Field of Search ..... 7/103; 81/488; 294/8.6; 254/200, 203; D8/15; 29/243.5

[56] References Cited

U.S. PATENT DOCUMENTS

| | | | |
|---|---|---|---|
| 3,538,523 | 11/1970 | Sparks | 7/103 |
| 3,546,726 | 12/1970 | Bizzigotti | 7/103 |
| 3,737,932 | 6/1973 | Armijo | 7/103 |

*Primary Examiner*—Roscoe V. Parker

*Attorney, Agent, or Firm*—Oldham, Oldham & Weber Co.

[57] ABSTRACT

A carpet laying tool is disclosed comprising an angular member connected at one end to a carpet wedging, rotatable circular wheel, and at the other end to a carpet compressing, swivelable block member. The tool is used to wedge the carpeting being laid into the juncture of walls and floors, while simultaneously pressing it onto carpeting tack strips or an adhesive, whichever is being used to retain the carpet in place. The tool is used by holding it by the angular member and placing it horizontally on the carpeting, adjacent and at a slight angle to a wall, so that the wheel and block are both in contact with the carpeting. A downward force is then applied in the direction of the angle of tool disposition, and the tool is moved along the juncture in the direction of the wheel, simultaneously forcing the carpeting into the area of the juncture, and onto the tack strip or adhesive.

8 Claims, 2 Drawing Sheets

FIG.-1
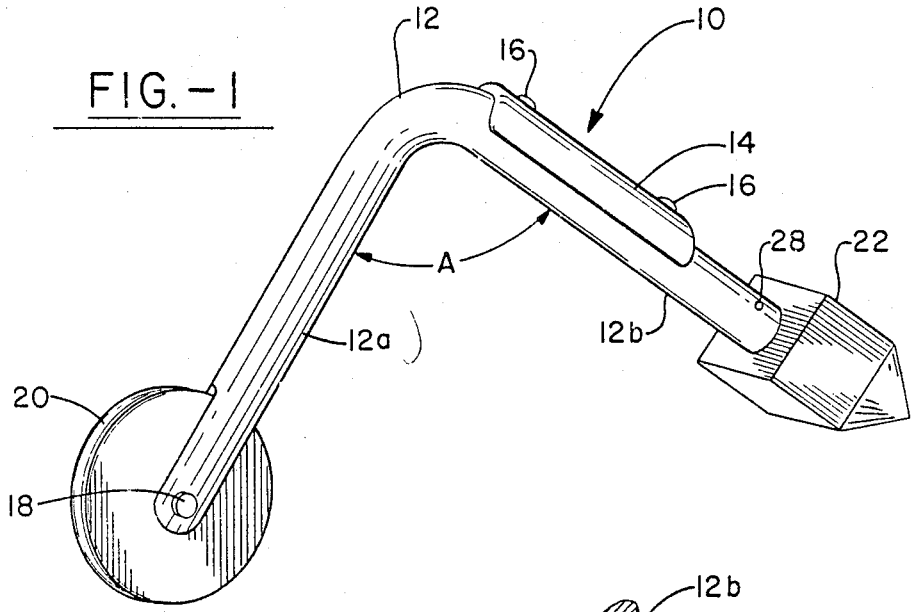
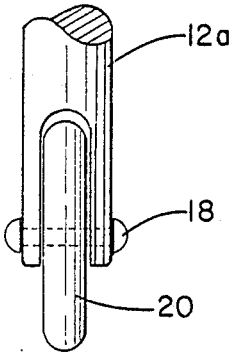
FIG.-2
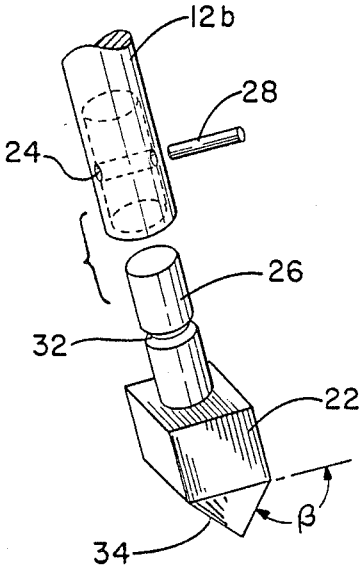
FIG.-3

CARPET LAYING TOOL AND PROCESS FOR USING SAME

This invention relates to an artisian's tool device. Particularly, this invention relates to a device useful in the installation of floor coverings. More particularly however, this invention is directed to a tool intended for use by carpet installers, a tool which permits installers to perform simultaneously installation steps that otherwise would require sequential operations to perform in the course of the carpet laying process.

TECHNICAL FIELD

For a number of years, what is generally called wall-to-wall carpeting has come to be a preferred type of floor covering for homes. Initially, such carpeting, specifically the type which consists of pile fibers fastened to a fabric backing, was installed by laying the carpeting on the floor to be covered and securing it in place with carpet tacks. The tacks were driven through the carpeting into the underlying floor along the edge of the carpeting adjacent to the walls of the room being covered. Such a procedure was time consuming, however, and retacking was required each time the carpeting had to be replaced. Because of these and other disadvantages, the procedure was eventually replaced by what is known in the trade as "tackless installations". An installation of the tackless type involves the installation of narrow, thin strips of wood, "tack strips", alongside and quite close to, usually within about one-quarter inch of the edge of the wall of the room to be carpeted. The strips, which themselves are fastened to the floor by means of nails every eighteen inches or so, are equipped with a series of pre-installed nails or pins which project upward from the strips, slightly angled to the walls so that carpeting attached thereto is unable to slip off the pins, and thus is held firmly in place.

In installing carpeting by the tackless method, and after the padding is laid in place, one edge of the carpeting is positioned along one side of the room where it is fastened on a previously installed tack strip, and the rest of the carpet is laid loosely across the floor to the opposite side of the room. Following this, a carpet stretcher device is braced against the first mentioned wall and extended over the loose carpeting to the vicinity of the opposite wall, where it brought into temporary attached engagement with the carpeting by means of a claw-like head. The stretcher device is then mechanically extended, stretching the carpet in the process, following which the free end of the carpeting is impaled on the tack strip along the wall adjacent to the free end, typically by means of a hammer. After this step, a portion of the extending surplus carpeting is wedged into the space between the wall and the tack strips. The process is completed by horizontally cutting off carpeting beyond such point, and removing the stretcher device.

The process described is resonably effective and can produce taut, essentially wrinkle-free carpeting. The process is relatively slow, however, since it involves so many steps. Furthermore, the wedging operation is frequently carried out with a sharp instrument, for example, in laying some types of carpet, by a screw driver pushed at intervals into the space at the intersection between the floor and the wall. This oftentimes results in puncturing such carpeting, and in any event, the carpeting is properly wedged only at the periodic points at which it is contacted by the screw driver.

Relatively recently, a different kind of carpeting, that with foamed rather than fabric backing, has come into wide spread use. The new carpeting is particularly popular in commercial installations, since it needs no padding, nor tacks to secure it to the floor, and stretching is usually not required. Foamed back carpeting is fastened to the floor directly, by means of adhesives which hold it firmly in place. The installation process involves initially folding the carpeting back along one wall, exposing the flooring underneath. An adhesive is then applied to the floor, and the carpeting carefully smoothed into place against the wall in such a manner as to eliminate the formation of air bubbles underneath. The unglued portion is then folded back over the installed area, adhesive is applied to the remaining floor, and the carpeting smoothed into place as in the first step. To insure a proper fit, the carpeting is cut slightly oversized; consequently, as the last area of carpeting is glued into place, a small surplus results. It is necessary to push this area firmly into the corner juncture of the floor with the wall so that the surplus can subsequently be cut off, leaving a clean, close fit at the juncture point. Again, this is normally done by forcing the carpeting into the juncture with a screwdriver or an equivalent tool, followed by pounding the carpeting along the wall with a hammer or similar tool to assure that the carpeting makes good contact with the adhesive on the floor adjacent to the juncture point. After the adhesive has set, the surplus is cut off horizontally at the juncture point.

As in the case of the fabric backed carpeting, and if carried out properly, the process can produce a smooth, well adhered installation with sharp, wall conforming edges. Even so, and as with the fabric backed carpeting, however, sequential steps are required to carry out the laying process, a time consuming process.

As can be appreciated, with labor costs an important factor in today's economy, it is desirable to utilize whatever time saving strategies can be devised. This is particularly true in regard to laying carpeting, since carpeting is increasingly coming under competitive pressure from other non-carpet types of flooring. Furthermore, the competition between carpet installers is intense, and many installers are now paid on a piecework basis. Consequently, ways in which to simplify the process of, and time required for installing carpets are constantly being sought.

DISCLOSURE OF THE INVENTION

In light of the foregoing, a first aspect of the invention is to provide a carpet laying tool that permits the performance of several carpet laying operations previously performed in sequence, simultaneously, so as to allow carpeting to be laid more rapidly.

A second aspect of the invention is to provide a carpet laying tool that is versatile, one having application both to fabric backed carpeting, as well as to carpeting with foamed backing.

A further aspect of the invention is to provide a tool that is simple, durable, inexpensive and easy to use in order that it will generate broad appeal among carpet installers.

A still further aspect of the invention is to devise a carpet laying tool that makes carpeting more affordable, thus benefiting consumers, as well as carpet installers, resulting in an improvement in the competitive position of the carpet industry as a whole.

An important aspect of this invention is to provide a tool that produces a neater and more uniform carpeting edge margin with room walls than is usually obtained with other carpet laying techniques.

The foregoing and other aspects of the invention, which will become apparent as the detailed description proceeds, are achieved by a carpet laying tool comprising:

a wedging member;

a swivel member, and an angular member connecting said wedging member and said swivel member.

Other aspects of the invention are attained by a process for laying carpeting with the aforesaid tool comprising disposing said tool on carpeting placed on a floor surface so that said wedging and swivel members are in contact with said carpeting, said tool being located immediately adjacent to a wall and at a slight angle thereto, pressing firmly down on said tool in line with the angle of deposition from said wall, and moving said tool along the carpeting horizontally, thereby wedging said carpeting into the area of juncture of the wall and floor, and simultaneously pressing the carpeting onto tacks or adhesive, as the case may be, located in the adjacent vicinity of said wall.

BRIEF DESCRIPTION OF THE DRAWINGS

The invention will be better understood when reference is had to the accompanying drawings in which:

FIG. 1 is an isometric drawing of the carpet laying tool the invention.

FIG. 2 is a partial front elevation showing the wedging wheel of the carpet laying tool described herein.

FIG. 3 is an exploded view tool of the invention in the region of the swivel block portion of the tool.

BEST MODE FOR CARRYING OUT THE INVENTION

Figure 4:
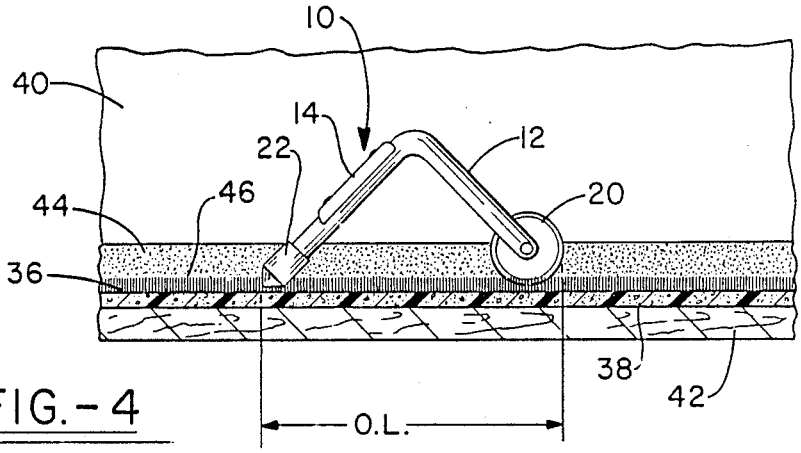
FIG. 4 is a side elevation of the carpet laying tool in position of use.

Referring now to the drawings, FIG. 1 shows the carpet laying tool of the invention, indicated generally by the numeral 10, comprising a body portion 12, fitted with a handle 14 which may be fastened to the body with suitable fasteners 16. Attached to body 12 by means of an axle pin 18 is a rotatable carpet wedging wheel 20. Also attached to body 12 is a carpet compression member or swivel block 22 which is rotatably attached to the body by swivel pin 28.

The tool is used by grasping it at the handle 14 and placing it at a slight angle from the vertical at the juncture of the wall and floor of the room being carpeted. When the tool is in such position, it is pushed firmly downwardly in the direction of such angle and pushed horizontally along the wall-floor juncture, preferably in the direction of the wedging wheel 20.

When the tool is used in the manner described, it accomplishes two otherwise separate operations simultaneously. First, the wedging wheel 20 forces the carpeting into the space between the tack strip and the wall, in the case of a tackless installation. As this is occurring, the swivel block 22 simultaneously pushes the carpeting down onto the tacks protruding from the tack strip.

A particular advantage of the simultaneous operation described is that tack penetration occurs at the same time as the wedging takes place. This is important since it relieves the tension on the wedged carpet, essentially eliminating the tendency which it would otherwise have to pull back out of its wedged position due to the tension on the carpeting, prior to the following step of being impaled on the tack strip. The net result is that not only is the operation faster, since it performs two operations simultaneously, but it produces a neater, better installation. A similar benefit is realized with foamed backed carpeting, since it is pressed firmly into the adhesive at the same time that it is being wedged, the adhesive relieving the tension on the wedged carpeting.

The body portion 12 of the tool will be made of a suitable metal such as steel, bent in an angle such that when the tool is grasped at the handle 14, there will be sufficient clearance for the fingers wrapped around the tool underneath the handle to avoid contact with the floor. In the context of the dimensions hereinafter discussed, such angle, designated A in the Figure, will normally be from about 60 to 120 degrees, more preferably from 80 to 100 degrees. Although the legs of body may be greter or smaller, the wheel leg, **12*a*, will usually be from about 3 to 5 inches long, while the block leg, 12*b***, will be from about 5 to 7 inches long.

Furthermore, while the overall length of the tool, designated as dimension O.L. in FIG. 4, may also be somewhat greater or smaller, it has been found desirable to employ a length of from about 8 to 11 inches.

The handle 14 may be fashioned from any material such as plastic, wood, or rubber, or it may simply be formed as an integral metal portion of the block leg **12*b*. When handle 14 consists of a separate component, it can readily be attached to block leg 12*b* by means of fasteners 16**, which may be rivets, pins, or some other similar fasteners. The shape of the handle is relatively unimportant so long as it is comfortable to grasp firmly.

The diameter of the body 12 will ordinarily range from about $\frac{3}{4}$ to 1 inch in diameter, a size which provides adequate strength, and yet is in reasonable proportion relative to the other dimensions. Body 12 will ordinarily be fabricated from metal tubing having a wall section strong enough to withstand the bearing pressure of use, a determination well within the capability of those knowledgeable in the art.

FIG. 2 shows wedging wheel 20 mounted in block leg **12*b* by means of axle pin 18. The diameter of the wheel 20 may vary; however, a diameter of from about $1\frac{1}{2}$ to 3 inches has been found to be of advantage with respect to the other measurements described herein. The width of wheel 20**, which will normally be made from a metal such as steel, typically will range from about $\frac{1}{8}$ to 1/32 inch, and will be determined by strength consideration, as well as the desire to make the wheel thick enough to avoid cutting the carpeting, yet thin enough to be effective in wedging the carpeting in place.

FIG. 3 shows a swivel block 22 which is integrally attached to stem 26. Stem 26 is provided with a recessed annular ring 32. Stem 26 and attached swivel block 22 are usually fashioned from a metal such as steel, and stem 26 is of a diameter such that it can be inserted into the tubing of block leg **12*b* with a clearance just sufficient so that the stem can easily rotate freely therein. Once inserted, stem 26 is retained in the tubing of block leg 126 by means of pin 28, inserted through hole 24, so that it lies along the plane of annular ring 32, locking the stem to the block leg, but permitting it to rotate freely longitudinally relative to block leg 12***b*.

Swivel block 22 is a monolithic object having a compound shape comprising a hexahedron, which may be a cube, one base surface of which extends into a right rectangular pyramidal shape. The angle B, which the sides of the pyramid 34 form with the base, are such that when the tool 22 is placed in its position of use, one of such sides may be disposed substantially horizontally, i.e., parallel to the surface of the floor. This enables the swivel block 22 to press firmly against the carpeting, either impaling the latter on the tack strip, or pressing it firmly against the attaching adhesive, as the case may be. While a swivel block 22 with the shape described is preferred for a variety of reasons, other pyrimidal shapes could also be employed, for example a frustrum or a right triangular pyramid, whether in connection with a hexahedron shape or not. Other tool end shapes might also be used, the swivel block 22 simply being intended to include a surface capable of aligning itself essentially parallel to the carpeting so that it can transmit pressure to it. It will be understood, therefore, that the shape and dimensions of block 22 are of secondary importance. Generally, however, when a triangular contact surface is used, it will be formed from a pyramidal shape having a height of about 1 to 1½ inches. When the pyrimidal shape forms part of a hexahedron, the latter will have base sides of about 1 to 2 inches and a length of about ¾ to 1½ inches. It has also been found convenient to have the width of the pyramid base, which is the same as the base width of the hexahedron, roughly approximate the width of the tack strips. Furthermore, in order to accomodate varying tack strips, it is sometimes desirable to employ interchangeable swivel blocks 22 to obtain tack strip matching widths.

Inasmuch as the tool 10 is held at an angle to the wall while a side 34 of the swivel block 22 must be parallel to the floor, it is necessary that the swivel block be free to swivel or rotate within block leg 12*b* so that one side of the pyramid base, or surface of a tool end other than a pyramid when a different tool end shape is used, can align itself with the carpeting. While other methods of swivably connecting block 22 to block leg 12*b* may be used, such a connection can be conveniently accomplished conveniently by annular recessed ring 32, which in combination with pin 28 holds stem 26 in place. Assembly of the block 22 with block leg 12*b* is readily accomplished by inserting stem 26 into the block leg until ring 32 is adjacent to hole 24. Pin 28 is then inserted through hole 24, thereby coming into engaging contact with ring 32. Stem 26 is thus held securely in block leg 12*b*, but in a manner in which the stem is free to rotate. While any type of snug fitting pin 28 may be used for the connecting purpose, it is also possible to use a different type of fastener such as a cotter pin, rivet, bolt or others of the types well known in the art.

FIG. 4 provides a side view of the carpet laying tool 10 disposed in its position of use with swivel block 22 pressing against carpeting 36, the latter being shown resting on a layer 38 which represents either foamed backing or padding, depending on which type of carpeting is being laid. In the Figure, wedging wheel 20 is pressing the carpeting into the area of the juncture of wall 40 and floor 42. The surplus carpet 44 is shown extending partially up the wall 40 prior to being cut off flush at the height of carpeting surface 46.

Figure 5:
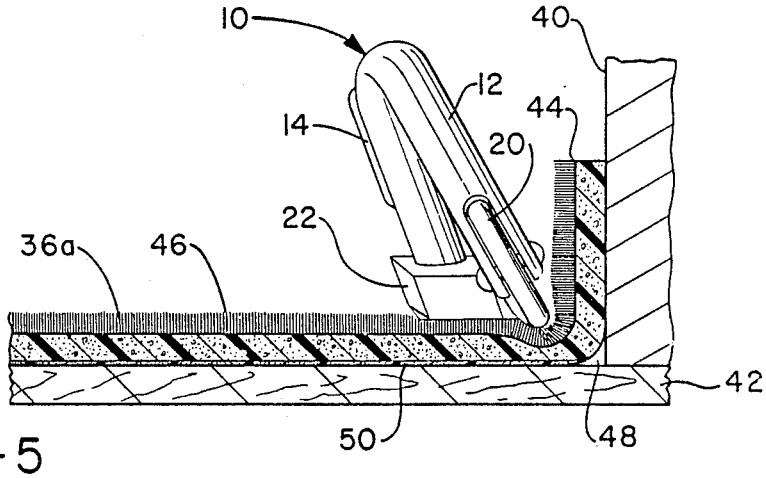
FIG. 5 is a front elevation of the tool being employed to lay foamed back carpeting.

FIG. 5 is an end view of the tool 10 clearly showing the manner in which the tool is held at a slight angle away from wall 40. The Figure also shows how swivel block 22 aligns itself with the surface 46 of the foamed back carpeting 36(*a*) while wedging wheel 20 is pressing the carpeting into the juncture 48 between wall 40 and floor 42. The foamed backed carpeting 36(*a*) illustrated is held to the floor 42 by means of a layer of adhesive 50. Also shown is the carpeting surplus 44 which will be cut off with a cutting tool after tool 10 has performed its function.

Figure 6:
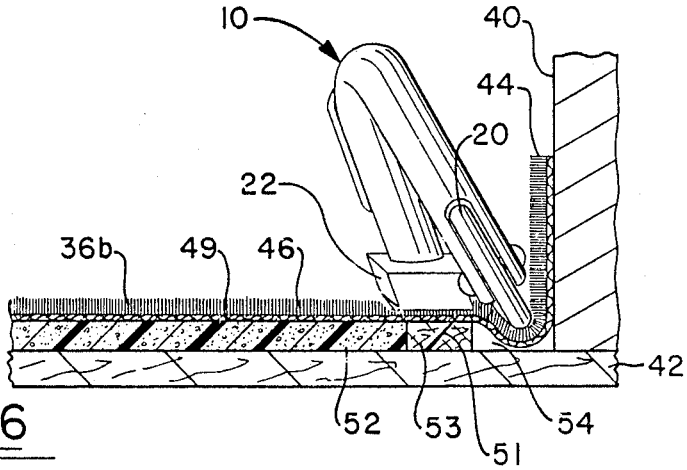
FIG. 6 is a front elevation of the carpet laying tool in the process of laying fabric backed carpeting in a tackless installation.

FIG. 6 is similar to FIG. 5 except that in FIG. 6 the carpet being laid is fabric backed. In the Figure, swivel block 22 has conformed to the surface 46 of the carpeting 36(*b*) despite the fact that tool 10 has been disposed at an angle with respect to wall 40. In its position of use, it is forcing the fabric of the carpet backing 49 onto the tacks 51 of tack strip 53 which lies adjacent to padding 52. Wedging wheel 20 is seen forcing the carpeting down into the space 54 between wall 40 and tack strip 53, after which the surplus 44 will be cut off level with carpet surface 46.

While in accordance with the patent statutes, the best known embodiment of this invention has been described in detail, it is to be understood that the invention is not limited thereto or thereby, but that the scope of the invention is defined in the appended claims.

What is claimed is:

1. A carpet laying tool comprising:

a circular wedging member;

a swivel member, and an angular member, said angular member comprising an elongated, elbow-shaped bar connecting said wedging member and said swivel member, and said swivel member being affixed to one end of said angular member and rotatable about the longitudinal axis of said angular member.

2. A carpet laying tool comprising:

a wedging member;

a swivel member, and an angular member connecting said wedging member and said swivel member, wherein said swivel member has multiple faces which can rotate relative to said angular member so that in the tool's position of use, one such face of said swivel member can always be positioned substantially horizontally, and wherein said wedging member comprises a wheel which is rotatably mounted in said angular member.

3. A carpet laying tool according to claim 2 wherein said angular member is comprised of two legs which together define an angle such that when the tool is placed in its position of use in which said wheel and said horizontal face are simultaneously in contact with the carpet being laid, there is sufficient clearance between the carpeting and the leg nearest said face to permit the user's hand to clasp the tool.

4. A carpet laying tool comprising:

a wedging member;

a swivel member, and an angular member connecting said wedging member and said swivel member, wherein said wedging member is a wheel having a diameter of from about 1½ to about 3 inches, and wherein said swivel member includes a pyramidally shaped portion and is longitudinally rotatable relative to said angular member.

5. A carpet laying member according to claim 4 in which said angular member comprises a member of circular cross section having two legs which together define an angle of between about 60 to about 120 degrees.

6. A carpet laying tool according to claim 5 in which the overall length of said tool is from about 8 to about 11 inches.

7. A carpet laying tool according to claim 4 in which said wheel has a thickness of from about ¾ to 1/32 inch, and said swivel member is a compound shape comprising a monolithic hexahedron, one base surface of which extends into a right rectangular pyramidal shape.

8. A process for laying carpeting with the carpet laying tool of claim 1 comprising disposing said tool on carpeting placed on a floor surface so that said circular wedging and longitudinally swivelable members are in contact with said carpeting, said tool being located immediately adjacent to a wall and at a slight angle thereto, pressing firmly down on said tool in line with the angle of disposition from said wall and moving said tool horizontally along the carpeting, thereby wedging said carpeting into the area of the juncture of the wall and floor, and simultaneously pressing the carpeting onto tacks or adhesive, as the case may be, located in the adjacent vicinity of said wall.

* * * * *